US005584272A

United States Patent [19]

Pfeufer et al.

[11] Patent Number: 5,584,272

[45] Date of Patent: Dec. 17, 1996

[54] METHOD AND ARRANGEMENT FOR CONTROLLING AN ADJUSTING DEVICE FOR VEHICLES

[75] Inventors: Reinhard Pfeufer, Möglingen; Thomas Frey, Hassmersheim; Johannes Wehle, Möglingen, all of Germany

[73] Assignee: Robert Bosch GmbH, Stuttgart, Germany

[21] Appl. No.: 321,310

[22] Filed: Oct. 11, 1994

[30] Foreign Application Priority Data

Oct. 12, 1993 [DE] Germany ..... 43 34 720.7

[51] Int. Cl.[6] ..... F02D 11/10

[52] U.S. Cl. ..... 123/399

[58] Field of Search ..... 123/399

[56] References Cited

U.S. PATENT DOCUMENTS 4,622,936 11/1986 Junginger et al. ..... 123/399

4,849,896 7/1989 Burk et al. ..... 123/399

*Primary Examiner*—Andrew M. Dolinar

*Attorney, Agent, or Firm*—Walter Ottesen

[57] ABSTRACT

The invention is directed to a method and an arrangement for controlling a power adjusting device in motor vehicles. The adjustment of an electrically actuable power adjusting element is made in pregiven operating states. The power adjusting element is adjusted in accordance with a first value in the region of the full-load position of the power adjusting element, however, not at the full load position itself and is adjusted to a second value in the region of the completely closed position but not at the completely closed position itself.

13 Claims, 6 Drawing Sheets t
T1
DKI
OA
DKI (VL)

t
T1
T2
T3
T4
UA
DKI (LL)

t
T1
T2
T3
T4
DKV
DKVOA
DKV (VL)
DKV (LL)
DKVUA

METHOD AND ARRANGEMENT FOR CONTROLLING AN ADJUSTING DEVICE FOR VEHICLES

BACKGROUND OF THE INVENTION

U.S. Pat. No. 4,622,936 discloses a method and an arrangement for controlling an adjusting device in the context of a power adjusting element such as a throttle flap of an internal combustion engine. The power adjusting element is controlled and adjusted in dependence upon an operating variable which is preferably the position of an operator-controlled element. In this patent, the problem is considered that a precise correspondence of driver command and throttle flap position is required for precisely driving the power adjusting element. The position of the power adjusting element changes, for example, because of deterioration over time or because of a scattering with respect to individual elements and other inaccuracies caused by mechanical tolerances and adjustments. To solve this problem, the above-mentioned patent discloses that the mechanical stops of the power adjusting element are adapted. More specifically, the idle stop as well as the full-load stop are continuously detected by means of a so-called learning process and the association of the position of the operator-controlled element and a desired adjustment value derived therefrom is correspondingly adapted for the power adjusting element. A controller then actuates the power adjusting element in correspondence to the desired adjusting value.

With this procedure, the correspondence between the position of the operator-controlled element and the adjustment desired value for the power adjusting element is adapted; however, an adaptation of the adjustment desired value and of the actual value transducer detecting the position of the power adjusting element cannot take place in this manner, that is, an adjustment of the controller for the position of the power adjusting element. In conventional systems, this is carried out by trimming resistors in combination with the manufacture of the control apparatus. However, this is associated with an increased work effort, increased costs, as well as additional sources of error. Furthermore, the stops are often driven into with the known procedure whereby mechanical damage is possible.

SUMMARY OF THE INVENTION

In view of the foregoing, it is an object of the invention to provide measures which permit the adjustment of a control system for positioning an adjusting device to be improved. The adjusting device can, for example, be a power adjusting device of an internal combustion engine.

With the invention, the adjustment of a control system for positioning an adjusting device such as a power adjusting device is considerably improved.

With the procedure provided by the invention, inaccuracies and batch variations in the electrical and mechanical components or inaccuracies occurring because of the adjustment of these components can be compensated or adjusted. In addition, the use of high-precision measuring means for making adjustments is unnecessary.

A precise adaptation of the desired adjusting value for setting the power adjusting device to the measured actual value is obtained with the method and arrangement of the invention.

This leads to a precise adjustment of the controller.

The method and arrangement of the invention is especially advantageous with respect to analog configured position controllers for positioning a power adjusting element wherein the desired adjusting value is pregiven by a computer element.

Corresponding advantages are also obtained in combination with digital position controllers.

It is especially advantageous that the adjustment of actual value transducer means for the position of the power adjusting element or the adjustment of the position controller is unnecessary so that a cost savings with respect to manufacture of the control apparatus and of the mechanical components is obtained.

In this way, not only can less expensive components be used but fewer components are needed. Also, the number of sources of error is reduced.

It is especially advantageous that a precise positioning of the power adjusting element at absolute zero is obtained by building in a learning process so that a precise metering of the adjustment of the power adjusting element is possible for an idle control already provided.

Furthermore, it is advantageous that the procedure provided by the invention is only carried out to its fullest extent when the control apparatus is taken into service for the first time after its voltage supply has been interrupted.

With the method and arrangement of the invention, the positioning values of the power adjusting element, which are pregiven for an ideal case, are positioned so that a precise adjustment of the power adjusting element is obtained without position deviations from the ideal values.

The method and arrangement of the invention are not only advantageous for power adjusting elements of internal combustion engines such as throttle flaps or diesel injection pumps, but also in combination with other adjusting devices of motor vehicles.

BRIEF DESCRIPTION OF THE DRAWINGS

The invention will now be described with reference to the drawings wherein:

FIGS. 4*a* to 4*c* show the method of the invention wherein FIG. 4*a* shows the switching signal of an ignition switch as a function of time; FIG. 4*b* shows the position of the power adjusting element DKI as a function of time; and, FIG. 4*c* shows the input value DKV as a function of time;

DESCRIPTION OF THE PREFERRED EMBODIMENTS OF THE INVENTION

Figure 1:
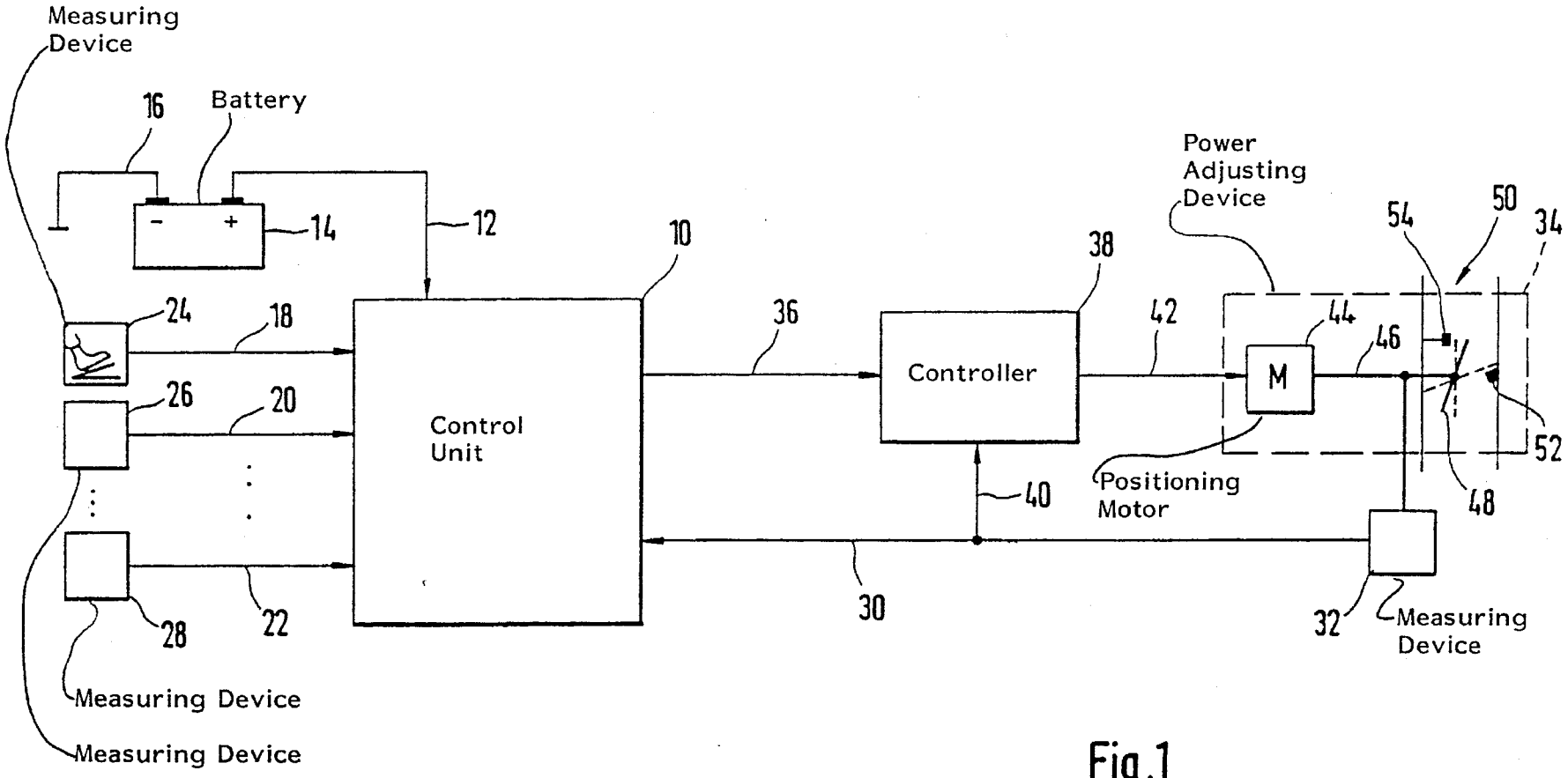
FIG. 1 is an overview block circuit diagram of a control system for positioning an adjusting device, namely, a power adjusting device for an internal combustion engine.

FIG. 1 shows an overview block circuit diagram for a control system for positioning an adjusting device, namely, a power adjusting device of an internal combustion engine, in accordance with a preferred embodiment of the invention. Reference numeral 10 identifies a control unit which at least includes one computer (not shown) and memory elements. This control unit is supplied via a line 12 with voltage from battery 14. The line 12 is connected to the positive pole of the battery. A line 16 connects the negative pole of the battery to ground. Lines 18 and 20 to 22 lead to the control unit 10. The measuring device 24 for detecting the position of an operator-actuated element is connected to the control unit 10 via line 18. Measuring devices 26 to 28 are connected to the control unit 10 via lines 20 to 22, respectively. The measuring devices 26 to 28 protect operating variables of the internal combustion engine or of the motor vehicle for controlling the engine.

A measuring device 32 is provided for detecting the position of the adjusting device 34 and is connected to the control unit 10 via line 30. The adjusting device 34 is a power adjusting device in a preferred embodiment of the invention. An output line 36 leads from the control unit 10 to a controller unit 38. Line 40 connects line 30 to the controller unit 38. The output line 42 of the controller unit 38 leads to the power adjusting device 34 and is there connected to the electric positioning motor 44. The motor 44 is connected via a mechanical connection 46, on the one hand, to measuring device 32 while, on the other hand, the mechanical connection is also connected to the power adjusting element 48 itself. The power adjusting element 48 is preferably a throttle flap mounted in the intake channel 50 of the internal combustion engine. The power adjusting element 48 can be displaced between two stops. One of the stops is a minimum stop or lower stop 52 and the other stop is a maximum or upper stop 54 (full-load stop). The throttle flap 48 is shown in the minimum and maximum positions by two respective lines in phantom outline.

The operation of the arrangement shown in FIG. 1 will now be explained.

The control unit 10 forms a desired positioning value for the power adjusting device 34 or the adjusting element 48 in dependence upon the position of the operator-controlled element supplied via line 18; that is, in dependence upon the command of the driver and, if required, while taking into account additional operating variables which are supplied via the lines 20 to 22. The additional operating variables participate in the formation of the desired adjusting value and are, for example, engine rpm, engine temperature, battery voltage, road speed, gear position, et cetera. The conversion of the driver command into a desired value takes place in a characteristic field which provides the dependency between driver command and positioning of the power adjusting element in dependence upon the operating variables while taking into account a maximum torque, minimum fuel consumption, et cetera. The desired value or the positioning input value DKV is outputted via the line 36 to the controller unit 38. The controller unit 38 comprises, in this embodiment, an analog configured position controller which includes proportional, integral and/or differential performance. This position controller forms an output signal in dependence upon the input value DKV and the actual signal DKI for the actual position of the power adjusting element. The actual signal DKI is detected by the measuring device 32. The output signal formed in this way actuates the positioning motor 44 via the line 42. The magnitude of the drive signal for the positioning motor 44 is determined on the basis of the difference between input value and actual value in the sense of an approximation of the actual value to the input value as known in control technology.

As shown above, the desired positioning value DKV is pregiven in dependence upon the driver command and represents an adjusting position of the adjusting element 48 or of the power adjusting device 34. The measuring device 32 detects the actual value of the adjusted position. For this reason, it is necessary that the correspondence of input value DKV and measured actual value DKI is adjusted. This correspondence is then dependent upon the tolerances of electrical components of the controller unit 38, the signal lines, the measuring device 32 and the positioning motor 44 as well as on the mechanical tolerances in the area of the power adjusting device 34. Furthermore, this correspondence can be influenced by temperature effects, deterioration, et cetera. For this reason, in a known system, the controller unit 38 or the measuring device 32 is trimmed by means of trimming resistors in order to compensate for these inaccuracies so that, when inputting a specific DKV value, the power adjusting device 34 or adjusting element 48 is guided approximately into this position represented by the DKV value independently of tolerances.

In order to be able to omit the adjusting operation, the detected position actual value DKI is supplied via the line 30 to the control unit 10. On the basis of the procedure provided by the invention, the control unit 10 determines a correction characteristic line which defines a relationship between the desired positioning value DKVKF and the input value DKV. This determination is made on the basis of input value DKV and actual value DKI and the positioning desired value is determined on the basis of the driver command from a characteristic field and the input value DKV drives the positioning element. In this way, the adjustment of the power adjusting device 34 corresponds to the position represented by the DKVKF value.

In addition to the preferred embodiment shown equipped with an analog position controller and the positioning of the throttle flap, the procedure provided by the invention is also applicable in other advantageous embodiments in combination with a digital controller which is included in the control unit 10. The invention is also applicable to a power adjusting device of a diesel engine such as the control rod of an injection pump. If several measuring devices for detecting the position of the power adjusting device 34 are provided which are redundant with respect to each other, then the method and arrangement of the invention can be applied for each measuring device so that a correction characteristic line is determined for each measuring device.

To determine the precise position of the lower stop 52, the method known from the state of the art described above is applied. The following steps are carried out in predetermined operating states especially in advance of the start of the engine: the adjusting element 48 is driven against this stop by actuating the positioning motor 44 pursuant to a pregiven ramp; contact with the stop is detected on the basis of the output signal of the controller on the line 42; and, the input value DKVUA which is then present is stored as representing the lower stop.

Figure 2:
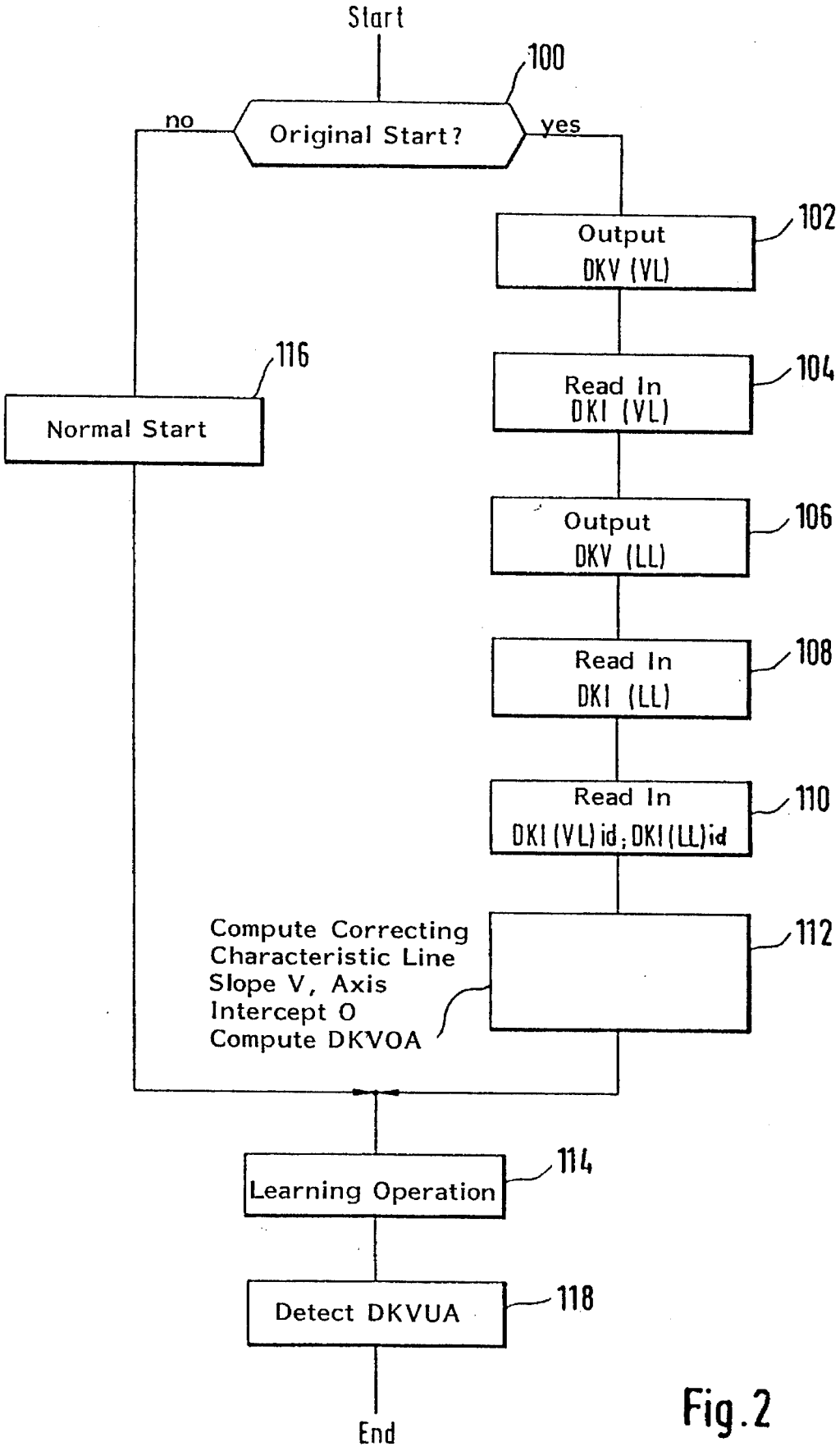
FIG. 2 shows a computer program in the context of a flowchart pursuant to which an embodiment of the method of the invention is carried out.

The computer program is shown in FIG. 2 in the context of a flowchart. This computer program is started for each start of the internal combustion engine which, in turn, is triggered by a closure of the ignition switch. In a first step 100, the inquiry is made as to whether a so-called original start is present. An original start is then present when the voltage supply of the control unit is interrupted; that is, the battery has been disconnected. Control units can have write memory elements which cannot retain stored information when there is a voltage interruption. This then has the consequence for such control units that all memory contents are extinguished even the adjusting values or the correction characteristic line determined as will be described below. Accordingly, with each original start, a new adjustment of the system is necessary. For control units having memory elements which retain the stored data even when there is a voltage interruption, the procedure shown in FIG. 3 must only be carried out during the production of the motor vehicle or when components are exchanged or at pregiven inspection intervals. In this case, in step 100, inquiries are made as to the following: a pregiven duration of operation of the engine, a pregiven number of kilometers driven, external data as from a diagnostic device, a manual actuable switch or, the foregoing notwithstanding, the above-mentioned original start.

After such a condition, preferably an original start, has been detected in step 100 on the basis of a mark, an input value DKV(VL) is outputted in the following step 102. This input value lies in the range of the full-load stop of the power adjusting element but is so selected that the mechanical full-load stop is not reached. In a preferred embodiment, this input value is at 85% of the value range of the input value extending from 0% to 100% After a pregiven time duration has elapsed, which the position controller requires for adjusting the input value, the real actual value DKI(VL) is read in in the next step 104. The real actual value is assigned to this input value. Thereafter, and in accordance with step 106, an input value DKV(LL) is outputted which lies in the region of the lower stop. As shown with respect to the full-load input value, this value too lies only in the range of the lower stop but is so selected that the mechanical stop of the power adjusting element 48 is not reached. In a preferred embodiment, this input value lies at 15% In other embodiments, these values can be selected advantageously between 5% and 30% or 50% and 90% It is only important that the mechanical stops are not reached.

After the initial controlling time has elapsed, the real actual value DKI(LL) is read in in the next step 108. The actual value DKI(LL) is assigned to this input value.

In addition to these values, an ideal characteristic line is stored in the control unit. This ideal characteristic line defines a relationship of the input value to the actual value. An ideal actual value (in the preferred embodiment 15% and 85%) is assigned to the input values outputted in steps 102 and 106. The ideal actual value is pregiven permanently. A so-called counter-running position transducer is used in the preferred embodiment for which the measurement signal value becomes less with increasing opening of the power adjusting element 48. For this reason, these ideal position values for the input value DKV(VL) are less in amount than for the input value DKV(LL). The ideal position valves for both drive points are read in in step 110. In the preferred embodiment, the assigned ideal value DKI(VL) is 15% for an output DKV(VL) of 85%; whereas, for the output DKV(LL) of 15% the ideal value DKI(LL) amounts to 85%. An ideal characteristic line of the system is provided by means of the pregiven input values and the pregiven ideal values. A correcting line to be determined is stored forward with respect to the ideal characteristic line so that, when there is an output of the input value (DKVKF), the positioning value DKIideal is adjusted and is derived from the ideal characteristic line. Here it is insignificant whether the course of the position measuring values is counter running, such as in the preferred embodiment, or is, as in the other preferred embodiments, running in the same direction.

The correcting line is determined in step 112 after the ideal values are read in in step 110. This takes place by means of known straight line equations on the basis of the input values DKV(VL) and DKV(LL), the real measured values DKI (VL) and DKI (LL) as well as the corresponding ideal values. In the preferred embodiment, the slope V and the axial segment 0 of the correction characteristic line result on the basis of the following equations:

$$V=\frac{DKI(VL)\text{ideal}-DKI(LL)\text{ideal}}{DKI(VL)-DKI(LL)} \tag{1}$$

$$0=\frac{DKI(VL)-DKI(VL)\text{ideal}}{DKI(VL)-DKI(LL)}*DKV(LL)+\frac{DKI(LL)\text{ideal}-DKI(LL)}{DKI(VL)-DKI(LL)} \tag{2}$$

The correction characteristic line then results for the value DKVKF determined from the characteristic field:

$$DKV=V*DKVKF+0 \tag{3}$$

Furthermore, and in an advantageous manner, the position value DKVOA can be estimated on the basis of the correcting line. The positioning value DKVOA is assigned to the upper stop, that is, the full-load stop of the power adjusting element 48.

Thereafter, the learning operation known from the state of the art is initiated to exactly detect the lower stop value DKVUA in accordance with step 114. The step 114 is also initiated when the detection is made in step 100 that no so-called original start and also no other condition is present for which inquiry would have to be made as required.

This leads to the conclusion in accordance with step 116 that a normal start is present so that the correction characteristic line must not be determined but can be accepted as stored.

In the learning operation in step 114, the power adjusting element is driven in the direction toward the mechanical stop pursuant to a ramp until a drive against this stop is detected utilizing the controller output signal. The positioning value DKVUA which is then present is detected in accordance with step 118 and the positioning value DKIUA is then determined on the basis of the correction characteristic line. Thereafter, the subprogram is ended and is repeated with each new start of the engine.

The values for the input value, which are assigned to both stops, serve to determine the desired positioning range of the power adjusting element in accordance with the real conditions.

In addition to carrying out the subprogram shown above with the start of the engine, the learn operation is carried out in overrun operation in accordance with another advantageous embodiment.

Figure 3:
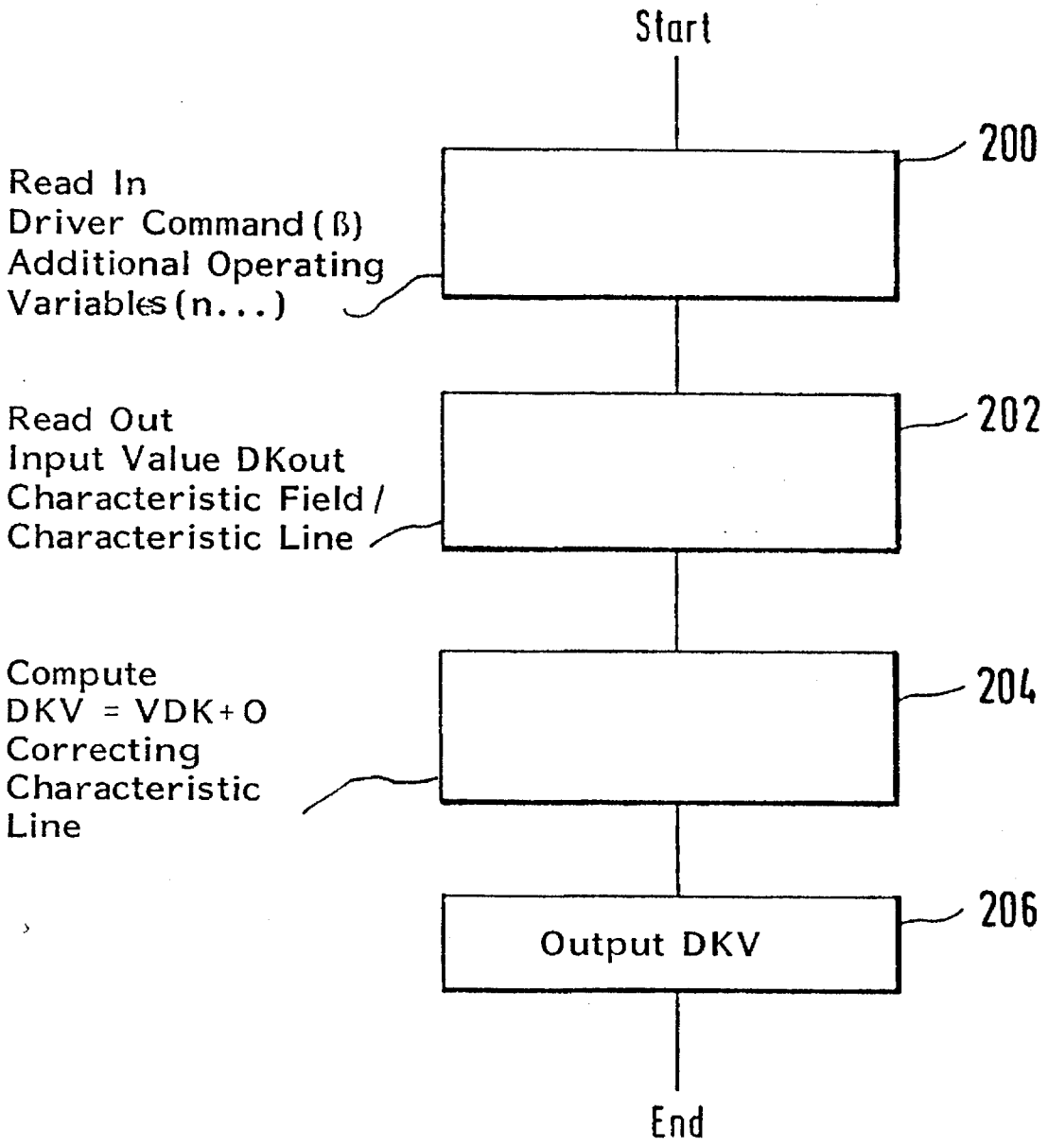
FIG. 3 is a flowchart showing a subprogram for determining the desired positioning value after carrying out the method of the invention.

The procedure for determining the input value while utilizing the correction characteristic line is shown in FIG. 3.

After the start of the subprogram shown in FIG. 3 at pregiven times or at pregiven positions of the crankshaft, driver command β, which corresponds to the position of the accelerator pedal in the preferred embodiment, as well as other operating variables are read in, as required, such as engine rpm n, engine temperature, battery voltage, gear position, et cetera. In the next step 202, the input value DKVKF is read out from a pregiven characteristic field or a pregiven characteristic line on the basis of the read-in variables as is known from the state of the art. The characteristic field then shows the dependence of the input value DKVKF on driver command. Different dependencies are pregiven for different engine rpms and gear positions, et cetera.

After reading out the input value DKVKF, the input value DKV to be outputted is computed in step 204 on the basis of the determined correction characteristic line in accordance with equation (3) and, if required, limited to the upper value DKVOA or the lower value DKVUA. The computed input value DKV is then outputted to the position controller in accordance with step 206. Thereafter, the subprogram is ended.

Figures 4A, 4B, 4C:
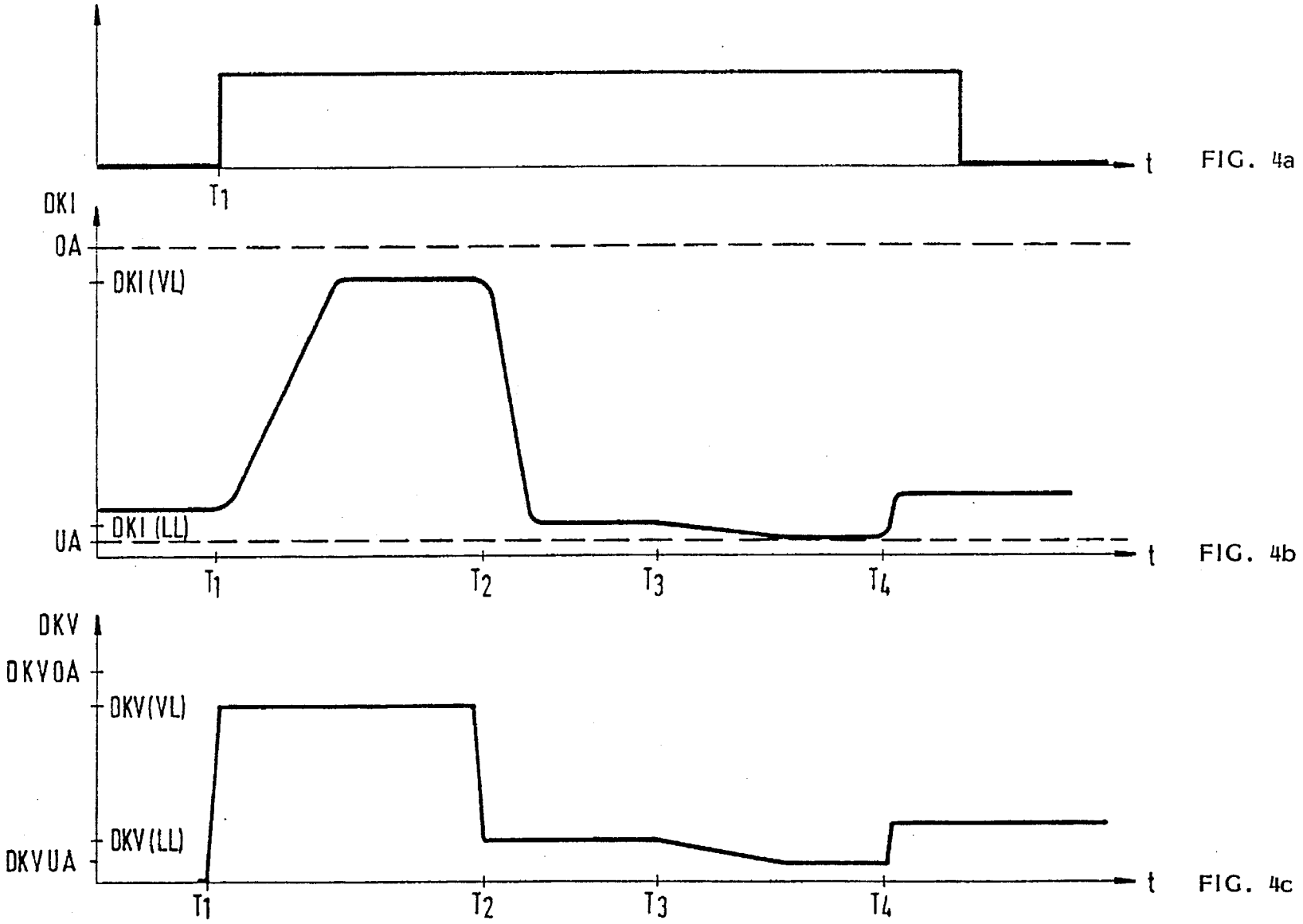

FIGS. 4*a* to 4*a* show the procedure provided by the invention with respect to time diagrams with respect to the position of the power adjusting element. FIGS. 4*a* shows the switching signal of the ignition switch; whereas, FIGS. 4*a* shows the position of the power adjusting element DKI as a function of time. FIGS. 4*c* shows the time-dependent trace of the input value DKV.

The ignition switch is closed at a time point T1. This leads to outputting the pregiven input value DKV(VL) when there is an original start or another requirement. The power adjusting element is moved out of its rest position to a position value DKI(VL) by the position controller. The position value DKI(VL) is detected and stored. At time point T2, at which the power adjusting element has reached the position corresponding to the input DKV(VL) because of the dynamic of the system, the pregiven input value DKV(LL) is outputted which leads to a control of the power adjusting element to the assigned value DKI(LL). This value is likewise detected and stored whereupon the correcting characteristic line is computed in accordance with equations (1) and (2) as well as the upper stop value DKVOA and the learn operation is initiated at time point T3. The input value DKV is supplied via a pregiven ramp until detection of the drive against the lower stop is made. The then present input value DKVUA is detected and stored. At time T4, the learn operation is concluded and the power adjusting element is brought to its start position and the engine started. If no original start is present, the procedure shown starting at time point T3 is carried out. The time durations are pregiven such that it is ensured that the pregiven position of the power adjusting element is reached and the necessary computations take place. Furthermore, in other advantageous embodiments, the learn operation is unnecessary or can be carried out at another time point independently of the procedure for determining the correction characteristic line.

Figure 5:
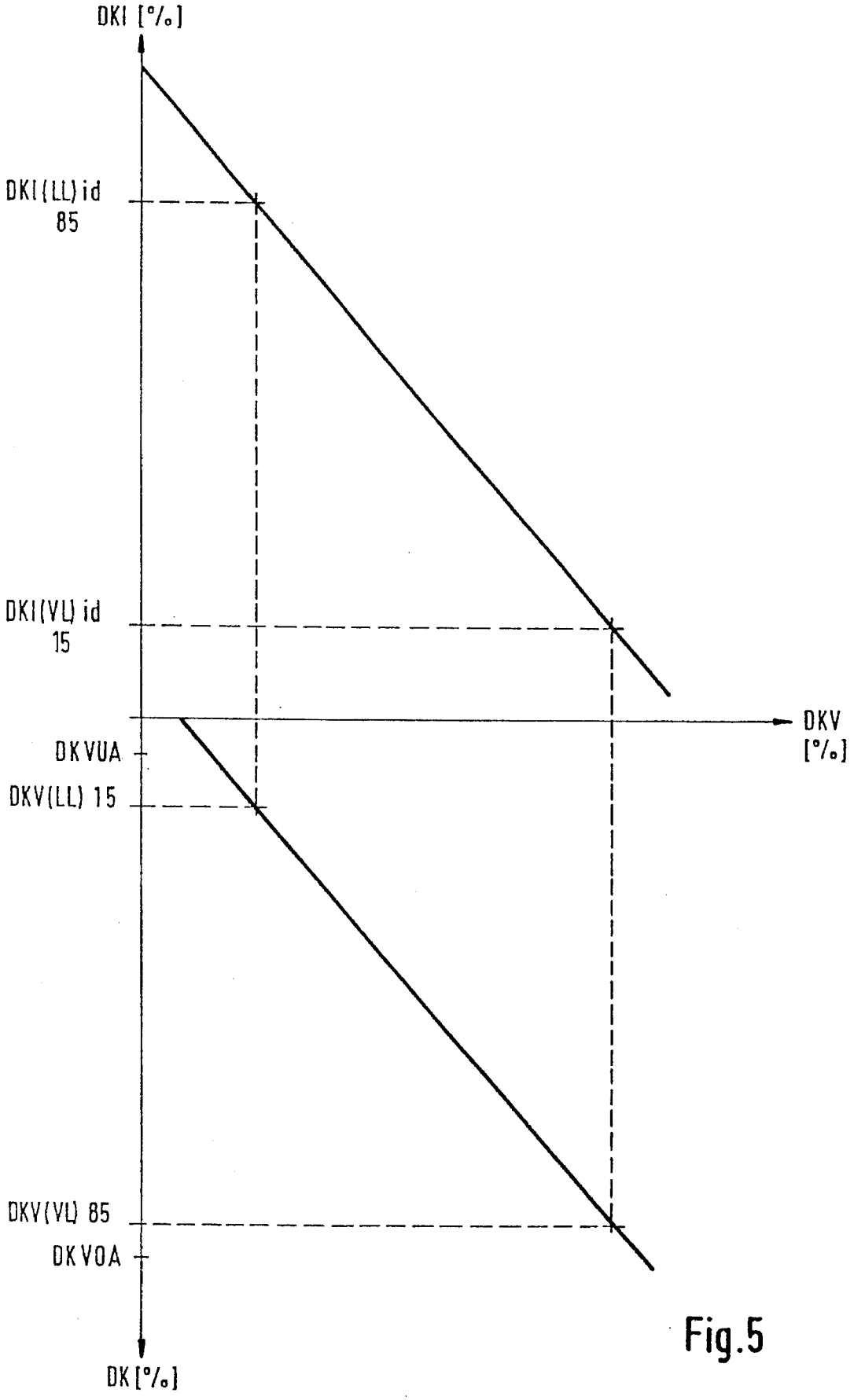
FIG. 5 is a graph showing the correlation between the correction characteristic line and the ideal characteristic line for carrying out the method of the invention; and, FIG. 6 shows the effect of the method of the invention wherein the positioning value DKI is plotted as a function of the input value DKV.

FIG. 5 shows the relationship between the correcting characteristic line and the ideal characteristic line. The correction characteristic line is shown in the lower portion of diagram and the value DK determined in dependence upon at least the driver command is along the vertical axis and the input value DKV which is to be emitted is along the horizontal axis. In the upper portion of the diagram, the position value DKI is plotted as a function of the input value DKV as a pregiven ideal characteristic line. The correction is then determined in such a manner that for an input value DKVKF of, for example 15%, the ideal value DKI(LL) ideal of 85% is set. In the same manner, for an input of 85%, the ideal value DKI(VL) ideal of 15% is set. The characteristic line is accordingly so determined that, for the input values DKV(VL) and DKV(LL) of 85% and 15%, respectively, the ideal position value is set. That means, the correction characteristic line contains a correction of the input value DK in such a manner that the ideal characteristic line of the position DKI of the power adjusting element adjusts relative to input value DKV supplied to the position controller.

Figure 6:
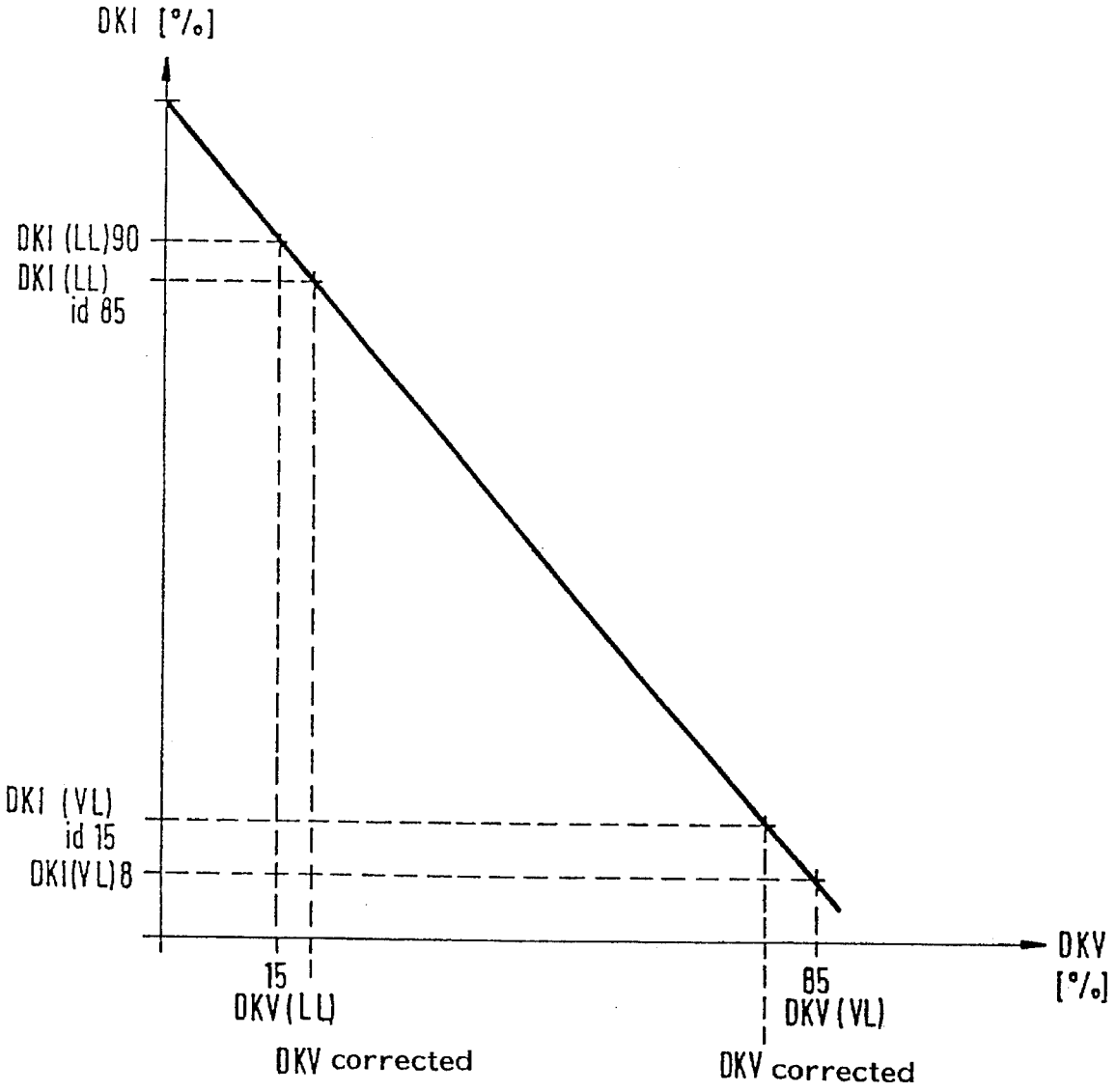

FIG. 6 shows the effect of the invention in another manner. The diagram shows the position value DKI plotted as a function of input value DKV. For forming the correcting characteristic line, the values DKV(LL) of 15% and DKV(VL) of 85% are outputted which, in the selected example, corresponds to an adjustment DKI(LL) of 90% and DKI(VL) of 8%. The ideal position values DKI(LL)ideal of 85% and DKI(VL) ideal of 15% are, however, assigned to these input values. These values are adjusted by computing the correction line for an input of DK of 15% or 85%; that is, to adjust the value 15%, an input value DKV corrected in correspondence to equation (3 ) is outputted. In the same way, for adjusting the value 85%, a corrected input value DKV is outputted. In this way, it is possible to realize an ideal pregiven characteristic line by correction of the input values based on the dependence of the position values on the input value.

It is understood that the foregoing description is that of the preferred embodiments of the invention and that various changes and modifications may be made thereto without departing from the spirit and scope of the invention as defined in the appended claims.

What is claimed is:

1. A method for controlling an adjusting device for a motor vehicle, the adjusting device including an electrically actuable power adjusting element movable between a fully open position corresponding to full load and a fully closed position corresponding to idle operation, the method comprising the steps of:

positioning said power adjusting element on the basis of an input value (DKV);

detecting the actual position (DKI) assumed by said power adjusting element;

in at least one pregiven operating state for compensating purposes, adjusting said power adjusting element to a first position in dependence upon a pregiven input value (DKV(VL)), which does not correspond to said fully open position;

adjusting said power adjusting element to a second position in dependence upon a pregiven second input value (DKV(LL)), which does not correspond to said fully closed position;

detecting first and second position values (DKI(LL), (DKI,(VL)) corresponding to said first and second position of said power adjusting element; and, making a correction of a relationship between said input value (DKV) and the actual position (DKI) and storing said correction which leads to an adjustment of said power adjusting element to pregiven first and second ideal values (DkI,(LL)id, DK(VL)id) for the respective input values (DKV(VL), (DKV(LL)).

2. The method of claim 1, said adjusting device including full-load and idle stops; and, wherein said pregiven first ideal value lies within the region of said full-load stop and said pregiven second ideal value lies within the region of said idle stop.

3. The method of claim 2, further comprising the step of processing the detected value (DKI) of said power adjusting element, said pregiven first and second ideal values, and said input value (DKV) to form a correction characteristic line for the input values so as to cause said power adjusting element to assume ideal position values corresponding to said pregiven first and second ideal values.

4. The method of claim 3, wherein the input values are desired values of a position controller for positioning said power adjusting element.

5. The method of claim 4, wherein the position values corresponding to said stops and the input values are determined.

6. The method of claim 5, wherein the mechanical stop value for said fully closed position is determined by a learning operation.

7. The method of claim 5, wherein the mechanical stop value corresponding to said fully open position is computed based on said correction characteristic line.

8. The method of claim 4, wherein said position controller is an analog position controller.

9. The method of claim 1, wherein said motor vehicle is equipped with an internal combustion engine and wherein said pregiven operating state is defined by the first start of said engine after the current supply is interrupted.

10. The method of claim 1, wherein said pregiven operating state occurs after a pregiven duration of operation or kilometers travelled by said motor vehicle.

11. The method of claim 1, wherein said pregiven state is initiated by external inputs including from a diagnostic apparatus or a switch actuation.

12. A method for controlling an adjusting device for a motor vehicle equipped with an internal combustion engine, the adjusting device including an electrically actuable power adjusting element movable between a fully open position corresponding to full load and a fully closed position corresponding to idle operation, the method comprising the steps of:

positioning said power adjusting element on the basis of an input value (DKV);

detecting the actual position (DKI) assumed by said power adjusting element;

compensating a relationship between said input value (DKV) and the actual position (DKI);

in a pregiven operating state for compensating purposes, positioning said power adjusting element in accordance with a pregiven first ideal value, which does not correspond to said fully open position; and, positioning said power adjusting element in accordance with a pregiven second ideal value, which does not correspond to said fully closed position;

said adjusting device including full-load and idle stops; and, wherein said pregiven first ideal value lies within the region of said full-load and said pregiven second ideal value lies within the region of said idle stop;

processing the detected value (DKI) of said power adjusting element, said pregiven first and second ideal values, and said input value (DKV) to form a correction characteristic line for the input values so as to cause said power adjusting element to assume ideal position values corresponding to said pregiven first and second ideal values;

the input values are desired values of a position controller for positioning said power adjusting element;

the position values corresponding to said stops and the input values are determined;

the mechanical stop value for said fully closed position is determined by a learning operation;

when said pregiven operation state is present, driving said power adjusting element in accordance with pregiven values; carrying out said learning operation to determine the position of said mechanical stop of said fully closed position; or, when said operating state is not present, only carrying out said learning operation when said engine is started.

13. An arrangement for controlling an adjusting device for a motor vehicle, the adjusting device including an electrically actuable power adjusting element, the arrangement comprising:

control means for positioning said power adjusting element on the basis of an input value (DKV);

said control means including: means for detecting the actual position (DKI) assumed by said power adjusting element;

means for positioning said power adjusting element in a pregiven operating state for compensating purposes including means for positioning said power adjusting element in accordance with a first input value (DKV(VL)) to a first position which does not correspond to said fully open position and for positioning said power adjusting element in accordance with a pregiven second input value (DKV(LL)) into a second position, which does not correspond to said fully closed position, and for determining actual first and second position values (DKI(LL)), DKI(VL)) of said power adjusting element corresponding to said first and second positions, respectively, and, for making a correction of a relationship between said input value (DKV) and the actual position (DKI) and storing said correction so that a pregiven ideal position value (DKI(LL)ID, DK(VL)id) of said power adjusting element is assumed for each of said input values (DKV(VL), DKV(LL)).

* * * * *

UNITED STATES PATENT AND TRADEMARK OFFICE
CERTIFICATE OF CORRECTION

PATENT NO. : 5,584,272

DATED : December 17, 1996

INVENTOR(S) : Reinhard Pfeufer, Thomas Frey and Johannes Wehle

It is certified that error appears in the above-identified patent and that said Letters Patent is hereby corrected as shown below:

In column 5, line 22: between "100%" and "After" insert -- . --.

In column 5, line 32: between "15%" and "In" insert -- . --.

In column 5, line 34: between "90%" and "It" insert -- . --.

In column 5, line 50: delete "valves" and substitute -- values -- therefor.

In column 5, line 54: between "15%" and "the" insert -- , --.

In column 6, line 13, in Equation (2): delete $$\text{"}\frac{DKI(LL)ideal-DKI(LL)}{DKI(VL)-DKI(LL)}\text{"}$$

and substitute therefor:

$$\text{--}\ \frac{DKI(LL)ideal-DKI(LL)}{DKI(VL)-DKI(LL)} * DKV(VL)\ \text{--.}$$

UNITED STATES PATENT AND TRADEMARK OFFICE

CERTIFICATE OF CORRECTION

PATENT NO. : 5,584,272

DATED : December 17, 1996

INVENTOR(S) : Reinhard Pfeufer, Thomas Frey and Johannes Wehle

It is certified that error appears in the above-identified patent and that said Letters Patent is hereby corrected as shown below:

In column 7, line 7: delete "4a" second occurrence and substitute -- 4c -- therefor.

In column 7, line 9: delete "FIGS. 4a" and substitute -- FIG. 4a -- therefor.

In column 7, line 10: delete "FIGS. 4a" and substitute -- FIG. 4b -- therefor.

In column 7, line 12: delete "FIGS. 4c" and substitute -- FIG. 4c -- therefor.

In column 7, line 51: between "that" and "for" insert -- , --.

In column 8, line 40: delete "position" and substitute -- positions -- therefor.

UNITED STATES PATENT AND TRADEMARK OFFICE

CERTIFICATE OF CORRECTION

PATENT NO. : 5,584,272 page 3 of 3

DATED : December 17, 1996

INVENTOR(S) : Reinhard Pfeufer, Thomas Frey and Johannes Wehle

It is certified that error appears in the above-identified patent and that said Letters Patent is hereby corrected as shown below:

In column 9, line 39: between "full-load" and "and" insert -- stop --.

In column 10, line 43: delete "(DKI(LL)ID," and substitute -- (DKI(LL)id, -- therefor.

Signed and Sealed this

Seventh Day of October, 1997

*Attest:*

*Attesting Officer*

Bruce Lehman

BRUCE LEHMAN

*Commissioner of Patents and Trademarks*